US005868017A

United States Patent [19]

Ebersohn et al.

[11] Patent Number: 5,868,017

[45] Date of Patent: Feb. 9, 1999

[54] LOCKING DEVICE FOR VEHICLES, PARTICULARLY FOR VEHICLE DOORS

[75] Inventors: Stefan Ebersohn, Simmozheim; Claus Töpfer, Sindelfingen, both of Germany

[73] Assignee: Mercedes-Benz AG, Stuttgart, Germany

[21] Appl. No.: 781,988

[22] Filed: Jan. 6, 1997

[30] Foreign Application Priority Data

Jan. 5, 1996 [DE] Germany ..... 196 00 224.9

[51] Int. Cl.[6] ..... E05B 65/36

[52] U.S. Cl. ..... 70/264; 70/255; 70/257; 70/277; 70/DIG. 30; 292/197

[58] Field of Search ..... 70/255, 257, 277, 70/264, DIG. 30, DIG. 42; 292/197, 234, DIG. 62; 200/9, 43.08

[56] References Cited

U.S. PATENT DOCUMENTS

| | | | |
|---|---|---|---|
| 2,189,346 | 2/1940 | Kamp | 70/264 |
| 2,212,251 | 8/1940 | Seelinger | 70/264 |
| 2,371,370 | 3/1945 | Ward | 70/264 |
| 2,694,920 | 11/1954 | Courtney | 70/264 |
| 2,996,910 | 8/1961 | Willis | 70/264 |
| 3,747,379 | 7/1973 | Cabanes | 70/264 |
| 3,751,950 | 8/1973 | Leger et al. | 70/264 |
| 4,346,573 | 8/1982 | Parsons | 70/264 |
| 4,440,006 | 4/1984 | Kleefeldt | 70/264 |
| 4,910,980 | 3/1990 | Katoh | 70/264 X |
| 5,050,410 | 9/1991 | Claar et al. | 70/237 |
| 5,224,364 | 7/1993 | Claar et al. | 70/264 X |

FOREIGN PATENT DOCUMENTS

| | | | |
|---|---|---|---|
| 1075975 | 2/1960 | Germany | 70/264 |
| 2811990 | 9/1979 | Germany | 70/264 |
| 3513555 | 11/1986 | Germany | 70/264 |
| 3827564C2 | 5/1989 | Germany . | |
| 3941086A1 | 6/1991 | Germany . | |
| 4114988 | 11/1992 | Germany | 70/264 |
| 217581 | 8/1990 | Japan | 70/264 |

*Primary Examiner*—Lloyd A. Gall
*Attorney, Agent, or Firm*—Evenson, McKeown, Edwards & Lenahan, PLLC

[57] ABSTRACT

A locking device for vehicles, particularly for vehicle doors has a mechanical revolving connection between a cylinder core of a lock cylinder and a safety lever of an assigned lock which comprises a driving coupling in the form of a lock nut. In order to achieve a simplification of the construction and mounting of the locking device while ensuring the operability of the locking device when it is operated mechanically as well as when the central locking system is operated, the lock nut is constructed in one piece. An end side of the lock nut facing an operating lever arm of the safety lever has two stops spaced angularly from one another and projecting from the end side. The operating lever arm engages between the stops, so that when the lock nut is rotated, a locking or unlocking position of the safety lever is achieved after an idling path. For the scanning of switches of a central locking system, two cams are arranged on the circumference of the one-piece lock nut which, with respect to one another, have a different angular position with respect to the lock nut circumference and are arranged relative to the stops in the circumferential direction in such a manner that, when the lock nut is rotated, the corresponding cam operates the respective assigned switch of the central locking system before one of the stops engages in the operating lever arm of the safety lever.

16 Claims, 1 Drawing Sheet

LOCKING DEVICE FOR VEHICLES, PARTICULARLY FOR VEHICLE DOORS

BACKGROUND AND SUMMARY OF THE INVENTION

This invention relates to a locking device for vehicles, particularly for vehicle doors of the type having a rotatable locking cylinder operable to control a central locking system as well as a safety locking lever.

A locking device of the construction of the above-mentioned type is known from German Patent Document DE 38 27 564 C2. The locking device described there contains a lock cylinder with a cylinder core into which a key can be non-rotatably inserted. The cylinder core is also non-rotatably connected with a revolving connection device constructed as a revolving rod which, by means of its end facing away from the lock cylinder, is fitted into a two-part lock nut which is rotatably disposed on the main plate. The lock nut consists of two shell bodies which are rotatably disposed on one another and are coupled with one another by way of a free running play while forming a driving connection. For this purpose, the front shell body driven by the revolving rod has a driving cam which engages in a circle-segment-type recess of the rear output-side shell body and can be rotated in it between the recess ends. After rotating the front shell body by way of the rotation of the cylinder core and the revolving rod fixedly connected with this cylinder core, after the free-running play in the recess, the rear shell body is also rotated. On its side facing away from the lock cylinder, the rear shell body has a driving pin which engages in an oblong hole of an operating lever arm of a lock-side safety lever. As the result of the rotation of the rear shell body, the safety lever is locked or unlocked depending on the rotating direction. On the circumference of the front shell body, two trip cams are arranged which are spaced away from one another on the circumference and whose contours are scanned by a switch of the central locking system. The central locking system is in each case triggered by the cam before the rear shell body can operate the safety lever. The front shell body therefore limits its function to the triggering of the central locking system, while the rear shell body has the function of mechanically operating, after another rotation of the key, the safety lever in the case of a failure of the central locking system.

Furthermore, it is known from German Patent Document DE 39 41 086 A1 that the position of the lock nut is scanned on the circumference of a one-piece lock nut, in which case two coding segments are arranged in an axially spaced manner on the circumferential surface of the lock nut and cover partial surfaces of different sizes. In this case, the coding segments have different angular positions with respect to the circumference of the lock nut and are arranged relative to one another such that, corresponding sensors are activated or that these sensors address a central locking system in the case of a rotation of the lock nut.

It is an object of the invention to further develop a locking device of the above-mentioned type in such a manner that its construction and mounting are simplified while the operability of the locking device is ensured when it is operated mechanically as well as when the central locking system is operated.

According to preferred embodiments of the invention, this object is achieved by providing an arrangement wherein the lock nut is constructed in one piece, two stops being arranged on an end side of the lock nut facing an operating lever arm of the safety lever, said stops being spaced away from one another by an angle of rotation and projecting from the end side and by means of which the operating lever arm situated between them during the rotation of the lock nut can be operated by way of the revolving connection device for the taking-up of a locking or unlocking position of the safety lever after an idle path, and wherein two cams are provided on the circumference of the lock nut for the scanning of switches of the central locking system, which cams have a different angular position to one another with respect to the circumference of the lock nut, said cams being arranged relative to the stops in the circumferential direction such that, when the lock nut is rotated, a corresponding cam operates the respective assigned switch of the central locking system as a function of the rotating direction, before one of the stops engages in the operating lever arm of the safety lever.

Because of the one-piece construction of the lock nut, and thus the elimination of a second lock nut part, and the free-running play displaced directly to the engaging of the lock nut with the safety lever for the unlocking and locking of the locking device, its construction is considerably simplified. In this case, the switching of the central locking system and the mechanical operability of the safety lever is concentrated on a single component. This clearly not only reduces the manufacturing costs of the locking device but the mounting is also facilitated by the simple axial clipping-in of the lock nut in one direction. The mounting of the lock cylinder is also improved because only the angular position of the nut relative to the lock cylinder must be fixed. In addition, it is advantageous that the manufacturing tolerances, which add up in the case of several components, will be eliminated, so that an improved switching point precision exists for the central locking system. Furthermore, an improved stability of the mechanical drive is obtained.

Other objects, advantages and novel features of the present invention will become apparent from the following detailed description of the invention when considered in conjunction with the accompanying drawings.

DETAILED DESCRIPTION OF THE DRAWINGS

Figure 1:
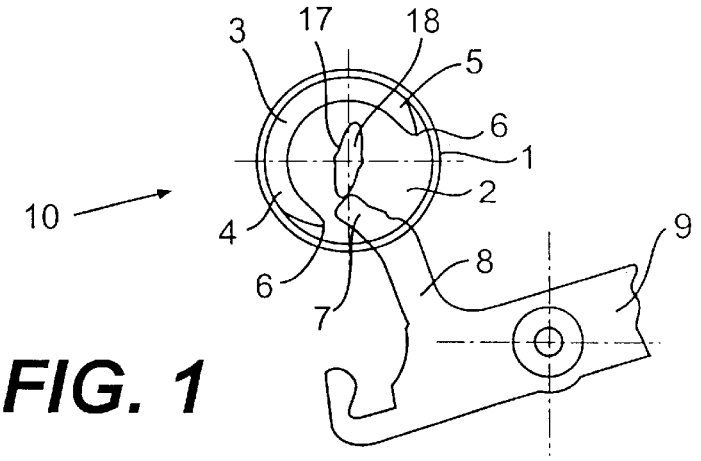
FIG. 1 is a schematic frontal view of a safety lever in sections and of a lock nut of a locking device according to the invention in an unlocked position and in the withdrawal position of a key.
Figure 2:
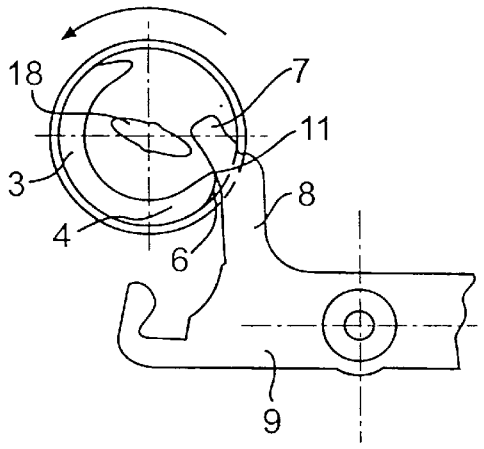
FIG. 2 is a schematic frontal view of the locking device according to the invention from FIG. 1, shown in a locked position and in an operating position of a key.
Figure 3:
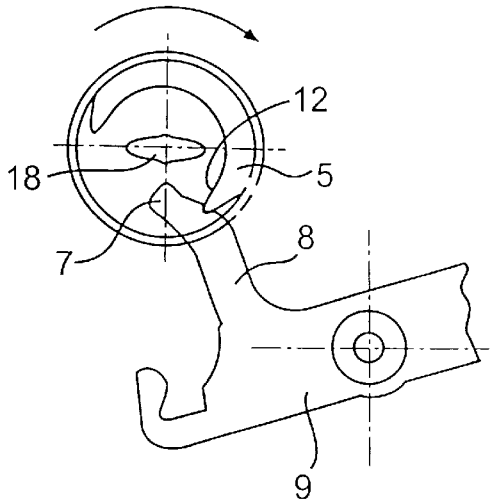
FIG. 3 is a schematic frontal view of the locking device according to the invention from FIG. 1 shown in an unlocked position and in an operating position of a key.

FIGS. 1 to 3 illustrate a one-piece lock nut 1 on whose front side or end side 2, which faces away from the lock cylinder, a crescent-shaped wall 3 is formed which extends along the circumference and projects from the end side 2. The two wall ends 4, 5 have an angular distance of approximately 1350° with respect to one another and, by means of their points 6, form stops for an end 7 of an operating lever arm 8 situated in-between in this angle area , which operating lever arm is arranged opposite to the end side 2 of the lock nut 1 and is part of a swivellably disposed safety lever 9 of the locking device 10. The double-wing-type end 18 of a revolving rod is non-rotatably fitted into a receiving opening 17 of the lock nut 1 and is non-rotatably connected with the cylinder core of the lock cylinder.

FIG. 1 shows an inoperative position of the locking device 10 in which, in a spring-loaded manner, the lock nut 1 is rotated back into a corresponding withdrawal position of a key which can be inserted into the lock core of the lock cylinder. In this case, the wall ends 4, 5 are disengaged from the operating lever arm 8 of the safety lever situated in the unlocked position.

When, according to FIG. 2, the key and therefore the cylinder core as well as the revolving rod and the lock nut 1 are rotated for the locking of the locking device 10, after an idle path extending in the circumferential direction, the tip 6 of the wall end 4 engages in a corresponding engaging recess 11 arranged in a negative-mold-type manner on the end 7 of the operating lever arm 8, in which case, after a further rotation of the lock nut 1, the operating lever arm 8 is caused by the wall end 4 to carry out a swivelling movement in the opposite direction, after which the safety lever 9 takes up its locking position.

For the unlocking of the locking device 10 according to FIG. 3, the lock nut 1 is rotated opposite to the rotating direction taking place during the locking movement, in the case of which, after a circumferential idling path—the free running play—the wall end 5 engages by means of its point 6 in a corresponding engaging recess 12 arranged in a negative-mold-type manner on the end 7 of the operating lever arm 8. As a result, during a further rotation of the lock nut 1, the operating lever arm 8 is swivelled back, after which the safety lever 9 takes up its unlocked position. Embodiments are also contemplated where the lock nut 1 can be rotated in a spring-loaded manner back into the inoperative position or the withdrawal position of the key when the locked or unlocked position is reached without any change of the achieved locking position.

The wall ends 4, 5 are advantageously constructed as points 6 so that a sliding-off of the ends 4, 5 and a change of contact is avoided which would occur in the case of a plane construction of the ends 4, 5 on the operating lever arm 8. This ensures a homogeneous sequence of movements during the locking and unlocking.

Figure 4:
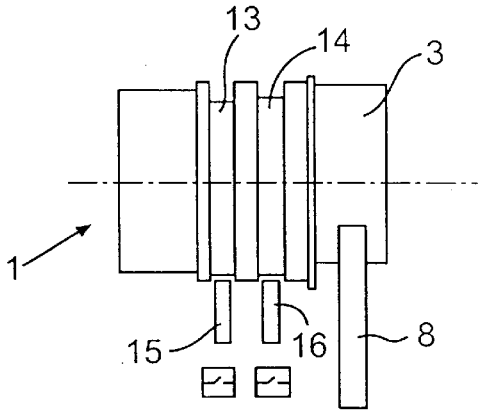
FIG. 4 is a schematic lateral view of the part of the locking device according to the invention from FIG. 1.

Before the operating of the safety lever 9 by means of the wall ends 4 or 5—depending on the rotating direction—two trip cams 13, 14, which are arranged on the circumference of the lock nut 1 and are spaced axially from the crescent-shaped wall 3 in the direction of the lock cylinder, are caused to engage by means of their control contours with switches 15, 16 of a central locking system, one of the trip cams 13, 14 initiating the unlocking and the other initiating the locking (FIG. 4). The relative rotating position of the trip cams 13, 14 is determined such that defined switching points are obtained for the operating of the automatic locking device and the mechanical operation without the occurrence of interactions between the two locking methods which interfere with the operation.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Closing device for vehicles, particularly vehicle doors, comprising:

a one-piece lock nuts, a safety lever of an assigned lock which comprises a driving coupling, a revolving connection device producing rotating movement of and driving the lock nuts, switching control of a central locking system being provided by rotation of the lock nut, the lock nut being coupled with the safety lever by way of a free running play to provide movement of the safety lever and having a receiving opening for forming a non-rotatable plug-type connection with the revolving connection device, two stops arranged on an end side of the lock nut facing an operating lever arm of the safety lever, said stops being spaced away from one another by an angle of rotation and projecting from the end sides, the operating lever arm being situated between said two stops during rotation of the lock nut and operated by rotation of the revolving connection device for the taking-up of a locking or unlocking position of the safety lever after engaging one of the stops, and two cams provided on the circumference of the lock nut for actuating switches of the central locking system, which cams have a different angular position to one another with respect to the circumference of the lock nut, said cams being arranged relative to the stops in the circumferential direction such that, when the lock nut is rotated, a corresponding cam operates the respective assigned switch of the central locking system, as a function of the rotating direction, before one of the stops engages the operating lever arm of the safety lever.

2. Closing device according to claim 1, wherein the stops are the ends of a crescent-shaped wall arranged on the circumference of the lock nut on its end side facing away from the revolving connection device.

3. Closing device according to claim 2, wherein the wall ends have points which point in the circumferential direction and to which engaging recesses are assigned on the operating lever arm of the safety lever.

4. A vehicle door lock assembly comprising:

at least one central locking system switch of a central locking system, a safety locking lever operable separately from the central locking system, and a one piece lock nut having a pair of stops and a switch scanning part which initiates operation of the central locking system, said stops being disposed to operably mechanically engage said locking lever in dependence on the position of the lock nut, and said switch scanning part being disposed to initiate operation of said central locking system in dependence on the position of the lock nut before mechanical engagement of said lever with either of said stops.

5. A vehicle door lock assembly according to claim 4, wherein said one piece lock nut is adapted to be connected to a rotatable cylinder core of a key engageable lock cylinder.

6. A vehicle door lock assembly according to claim 5, wherein said pair of stops protrude from an end of said lock nut.

7. A vehicle door lock assembly according to claim 4, wherein said one piece lock nut is rotatable.

8. A vehicle door lock assembly according to claim 7, wherein said stops are axially spaced from the switch scanning part.

9. A vehicle door lock assembly according to claim 7, wherein two switch scanning parts are provided for operating two respective locking system switches of the central locking system.

10. A vehicle door lock assembly according to claim 9, wherein said stops are circumferentially spaced from one another at one axial location on said lock nut, and wherein said switch scanning parts are a pair of switch scanning parts which are axially spaced from one another and from the stops.

11. A vehicle door lock assembly according to claim 10, wherein said one piece lock nut is adapted to be connected to a rotatable cylinder core of a key engageable lock cylinder.

12. A vehicle door lock assembly according to claim 7, wherein said stops are located at respective ends of a crescent shaped wall part on said lock nut, said safety locking lever being disposed to protrude radially into an open space between said stops.

13. A vehicle door lock assembly according to claim 12, wherein said switch scanning part and said stops are disposed such that the respective stops engage said safety locking lever only after rotative movement of the lock nut corresponding to actuation of said central locking system.

14. A vehicle door lock assembly according to claim 11, wherein said stops are located at respective ends of a crescent shaped wall part on said lock nut, said safety locking lever being disposed to protrude radially into an open space between said stops.

15. A vehicle door lock assembly according to claim 14, wherein said switch scanning part and said stops are disposed such that the respective stops engage said safety locking lever only after rotative movement of the lock nut corresponding to actuation of said central locking system.

16. A vehicle door lock assembly according to claim 9, wherein said switch scanning parts are a pair of switch scanning parts which are cam parts.

* * * * *